US010478367B2

(12) United States Patent
Anderson et al.

(10) Patent No.: US 10,478,367 B2
(45) Date of Patent: Nov. 19, 2019

(54) RECLINABLE THERAPEUTIC MASSAGE CHAIR

(71) Applicant: ERGO-FLEX TECHNOLOGIES, LLC, Bronson, TX (US)

(72) Inventors: J. T. Anderson, Bronson, TX (US); Linda C. Anderson, Bronson, TX (US)

(73) Assignee: Ergo-Flex Technologies, LLC, Bronson, TX (US)

( * ) Notice: Subject to any disclaimer, the term of this patent is extended or adjusted under 35 U.S.C. 154(b) by 587 days.

(21) Appl. No.: 14/750,323

(22) Filed: Jun. 25, 2015

(65) Prior Publication Data

US 2015/0290069 A1 Oct. 15, 2015

Related U.S. Application Data

(63) Continuation of application No. 13/438,515, filed on Apr. 3, 2012, now abandoned.

(51) Int. Cl.

| | |
|---|---|
| ***A61H 23/02*** | (2006.01) |
| ***A61H 1/00*** | (2006.01) |
| ***A61H 1/02*** | (2006.01) |
| ***A47C 1/024*** | (2006.01) |
| ***A47C 7/50*** | (2006.01) |

(52) U.S. Cl.

CPC ..... *A61H 1/008* (2013.01); *A47C 1/024* (2013.01); *A47C 7/506* (2013.01); *A61H 1/02* (2013.01); *A61H 1/0229* (2013.01); *A61H 1/0244* (2013.01); *A61H 1/0292* (2013.01); *A61H 23/02* (2013.01); *A61H 2201/0207* (2013.01); *A61H 2201/1664* (2013.01); *A61H 2201/1669* (2013.01); *A61H 2201/1676* (2013.01); *A61H 2201/5097* (2013.01)

(58) Field of Classification Search

CPC ..... A61H 1/02; A61H 1/0229; A61H 1/0244; A61H 1/0292; A61H 1/0218; A61H 1/003; A61H 1/0222; A61H 1/005; A61H 2201/0138; A47C 1/024; A61G 13/009

USPC ..... 606/240, 242, 244

See application file for complete search history.

(56) References Cited

U.S. PATENT DOCUMENTS

| | | | | |
|---|---|---|---|---|
| 2,494,746 A | | 1/1950 | Colston | |
| 5,098,158 A | * | 3/1992 | Palarski | A47C 1/022 297/234 |
| 5,437,609 A | * | 8/1995 | Leonard | A61H 1/0229 297/313 |
| 6,243,897 B1 | | 6/2001 | Sumiya | |
| 6,277,141 B1 | | 8/2001 | Lake | |

(Continued)

OTHER PUBLICATIONS

Non-final Rejection for U.S. Appl. No. 13/438,515 dated Oct. 20, 2014.

(Continued)

*Primary Examiner* — Justine R Yu
(74) *Attorney, Agent, or Firm* — Tumey L.L.P.

(57) ABSTRACT

A therapeutic massage chair is reclinable between a horizontal and inclined position. The chair includes an upper back support member and a lower support member that is axially movable along a support frame and is also rotatable about an axis which is perpendicular to the plane of the upper back support member. Electric linear actuators are provided to both axially move and oscillate the lower body support member.

7 Claims, 5 Drawing Sheets

(56) References Cited

U.S. PATENT DOCUMENTS

| | | | | |
|---|---|---|---|---|
| 6,692,451 | B2 * | 2/2004 | Splane, Jr. | A61G 13/009 128/845 |
| 7,189,214 | B1 * | 3/2007 | Saunders | A61F 5/04 5/618 |
| 7,285,128 | B1 | 10/2007 | Danzey | |
| 7,341,565 | B2 | 3/2008 | Splane, Jr. et al. | |
| 7,357,777 | B1 | 4/2008 | Meyers | |
| 7,654,974 | B2 * | 2/2010 | Bass | A61H 1/0218 297/284.1 |
| 8,002,797 | B2 | 8/2011 | Mayer | |
| 2013/0261510 | A1 | 10/2013 | Anderson et al. | |

OTHER PUBLICATIONS

Final Rejection for U.S. Appl. No. 13/438,515 dated Feb. 25, 2015.

* cited by examiner

RECLINABLE THERAPEUTIC MASSAGE CHAIR

CROSS-REFERENCE TO RELATED APPLICATIONS

This application is a continuation of U.S. application Ser. No. 13/438,515 filed on Apr. 3, 2012, which is incorporated by reference in its entirety.

BACKGROUND OF INVENTION

1. Field of the Invention

This invention is directed to a reclinable chair for use in the alleviation of back pain. The chair may be used by Chiropractors as part of their treatment of clients in an office environment or may be used by individuals at home for example.

2. Description of Related Art

Several devices have been proposed for use as treatment apparatus for pain but few have been commercially successful due to their high cost and complexity. Examples of such reclinable chairs are disclosed in U.S. Pat. Nos. 7,654,974; 7,341,565; and 6,277,141. These devices are cumbersome to use and are quite uncomfortable.

BRIEF SUMMARY OF THE INVENTION

The present invention is a relatively inexpensive and comfortable back pain treatment device designed for use in either a home or office environment.

A cushioned chair is tiltable from a horizontal position to an inclined orientation. The chair includes a back support portion and a second lower back, upper leg and lower leg support section that is movable in a first axial direction with respect to the back support section and is also arcuately movable about a pivot axis that is perpendicular to the axial direction. The chair includes remotely controlled linear actuators to control the relative movement of the different sections of the device. The chair may also include heaters and vibrators for additional therapeutic treatment.

BRIEF DESCRIPTION OF THE SEVERAL VIEWS OF THE DRAWING(S)

DETAILED DESCRIPTION OF THE INVENTION

Figure 1:
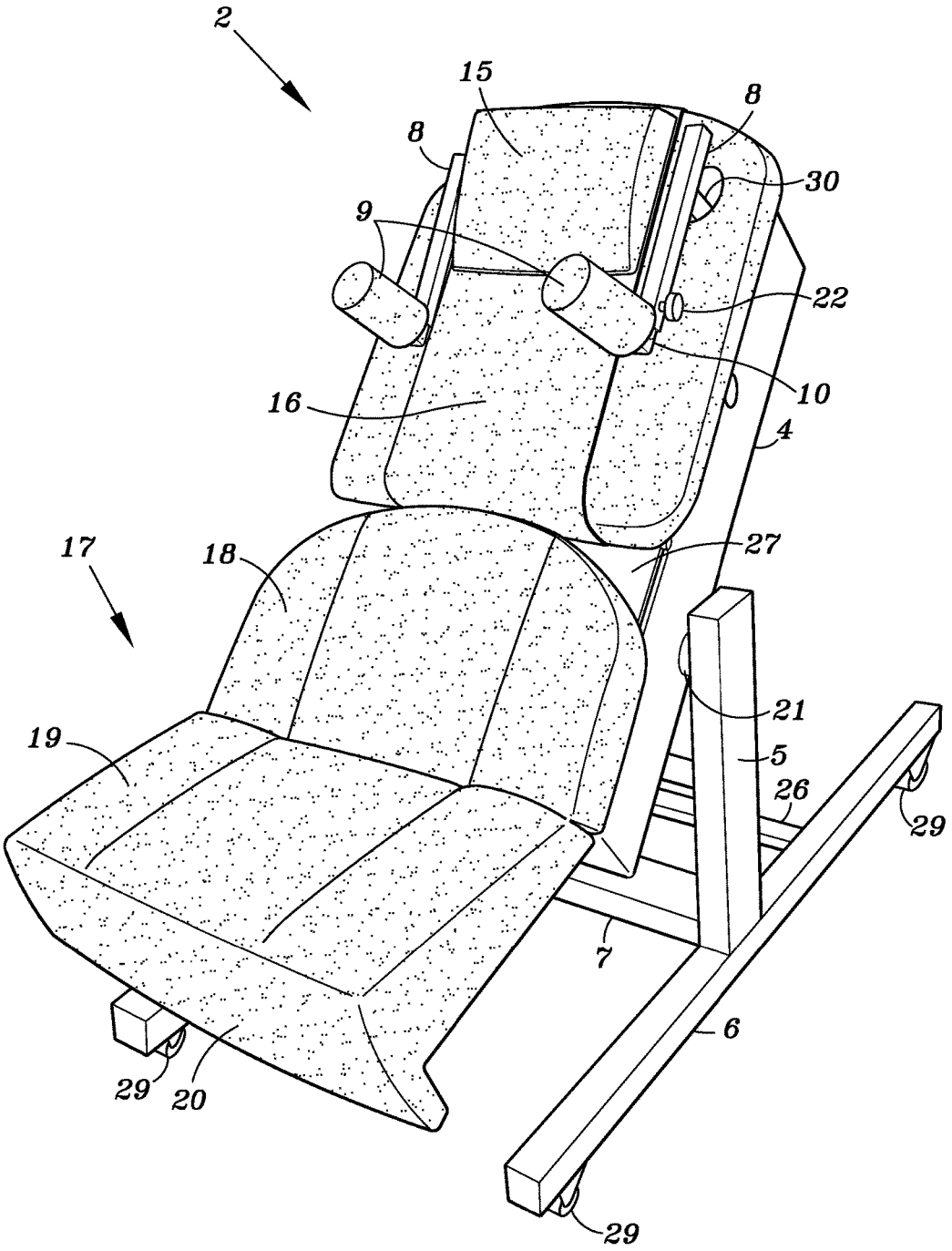
FIG. 1 is a perspective view of an embodiment of the invention showing the chair in an inclined position.

Referring to FIG. 1 the chair 2 of an embodiment of the invention includes a chair support frame 4 that is pivotably attached at 21 to a floor support assembly that includes vertical support posts 5. The floor support assembly for chair frame member 4 includes two parallel horizontal members 6 and 28, a cross support 7, and two vertical support posts 5, as more clearly shown in FIG. 2.

Horizontal support members 6 and 28 may have suitable castors 29 on their outer ends. Referring again to FIG. 1, chair 2 further includes an upper back support 16 secured to chair support frame 4. A head rest portion 15 may be provided for upper back support 16. A pair of underarm supports 9 are attached to the frame 4 by bars 8 and tubes 30 that fit within sockets 45 shown in FIG. 3. Cylindrical cushions 9 extend outwardly from supports 8 and are adapted to be located at the arm pits of a user. The length of the bars 8 may be adjusted by telescoping members 10 that slide within bars 8 and are lockable by a pin or detent 22 and holes 3 as is known in the art. Upper back support 16 may be formed as a cushion supported by a planar member attached to frame 4. Frame 4 includes a bottom closure 61.

Figure 2:
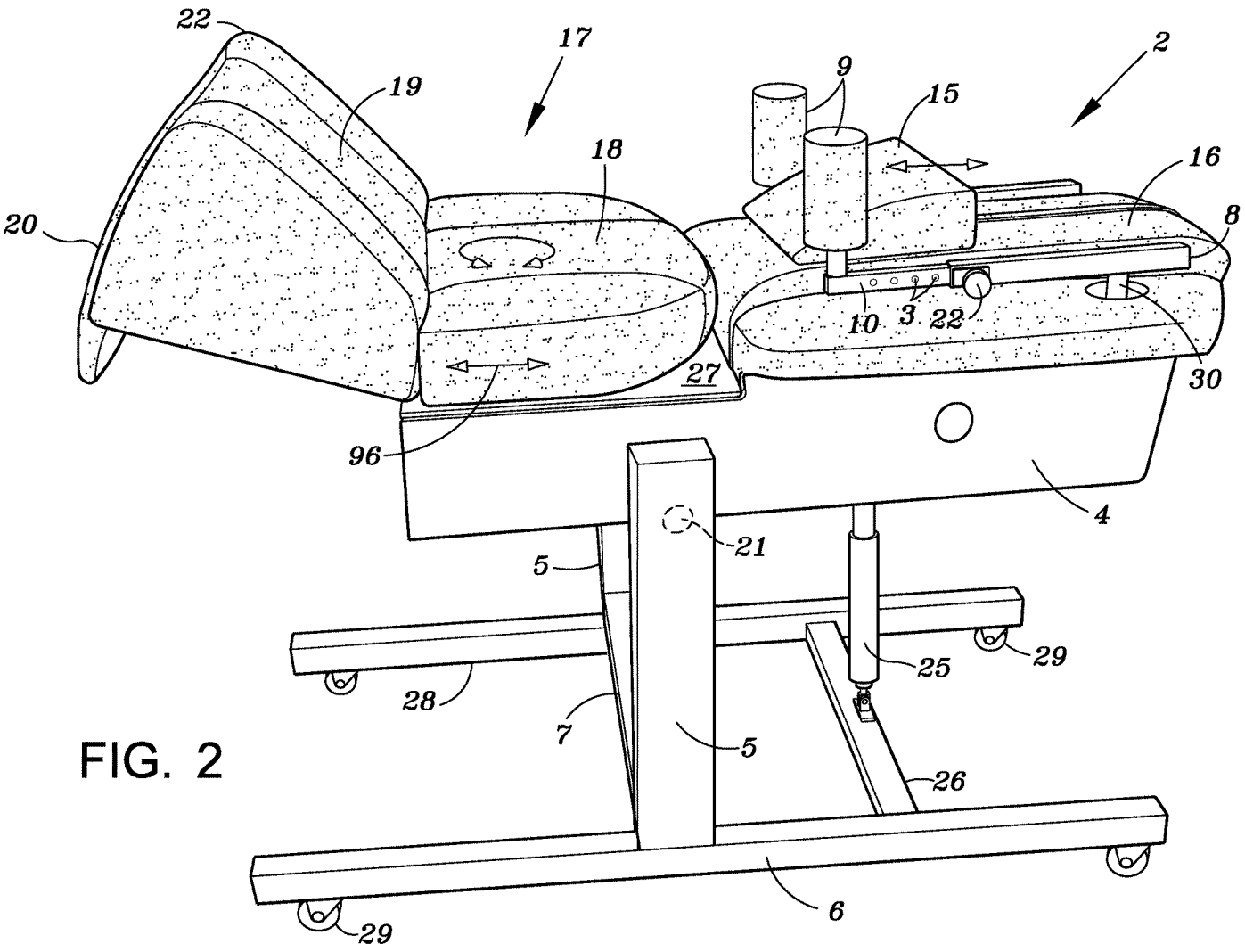
FIG. 2 is a perspective view of the embodiment of FIG. 1 showing the chair in a horizontal position.

Chair 2 also includes a lower body support member 17 that has three support sections 18, 19, and 20 integrally formed together as a unit. Surface 18 is adapted to support the lower back portion of a user, surface 19 supports the upper thighs of a user and surface 20 conforms to the lower legs beneath the knees. In use, the back of a user's knees will be located at point 22 of the lower support member. Lower body support member 17 is secured to a platform 27 which is mounted for reciprocal and oscillatory motion as will be explained later. As shown in FIG. 2, an electric linear actuator 25 is mounted on a cross support member 26 and extends to box frame 4 for pivoting the chair about pivot point 21 shown in FIG. 1.

The internal mechanism for extending and retracting lower body support member with respect to box frame 4 will now be discussed with reference to FIG. 3. A carriage member 50 is slidably supported on rails 59 that are attached to a stationary frame 60 which is secured to box frame 4. Box frame 4 includes an upper and lower rectangular frames 42 and 46 as well as side walls 102 and 103.

Stationary frame 60 includes a front wall portion 65 to which an electric linear actuator 56 including extension rod 57 is secured. The end of the extension rod 57 is attached to a cross beam 53 of the carriage member 50. Carriage member 50 includes upper and lower elongated plates 55 and 54 on each side and a vertical plate 91 extending between plates 55 and 54 on each side of the carriage. These plates are welded together and to an end plate 64. Each inner surface of vertical plate members 91 carries a longitudinally extending track member 58 which slides along a complimentary shaped track support 59 attached to the outer vertical surface of stationary frame 60. In this manner, as extension rod 57 of linear actuator 56 is extended or retreated, carriage member 50 will move accordingly.

Figure 3:
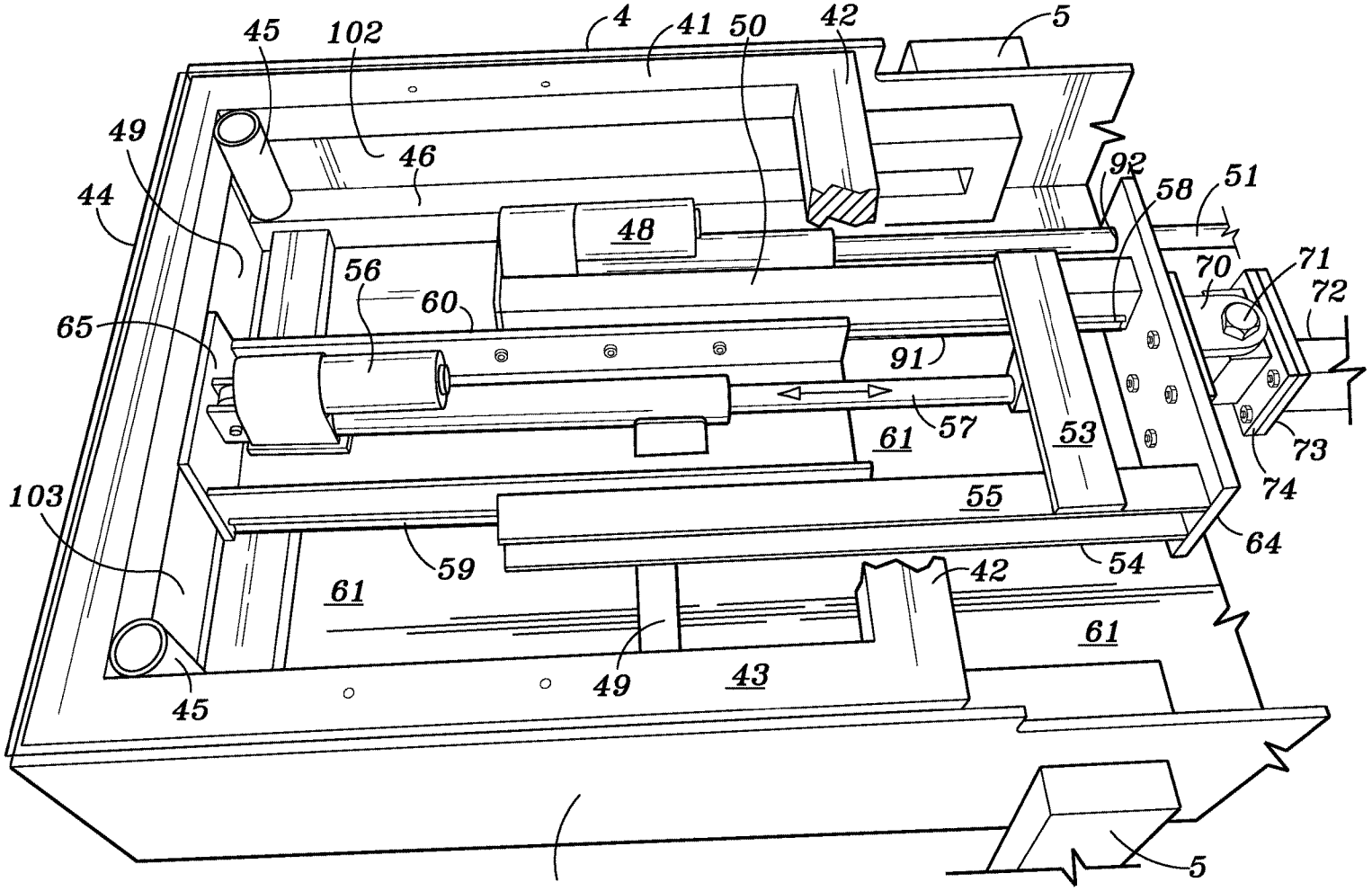
FIG. 3 is a perspective view of an embodiment of the reciprocating and oscillating mechanism for the lower portion of the chair.
Figure 4:
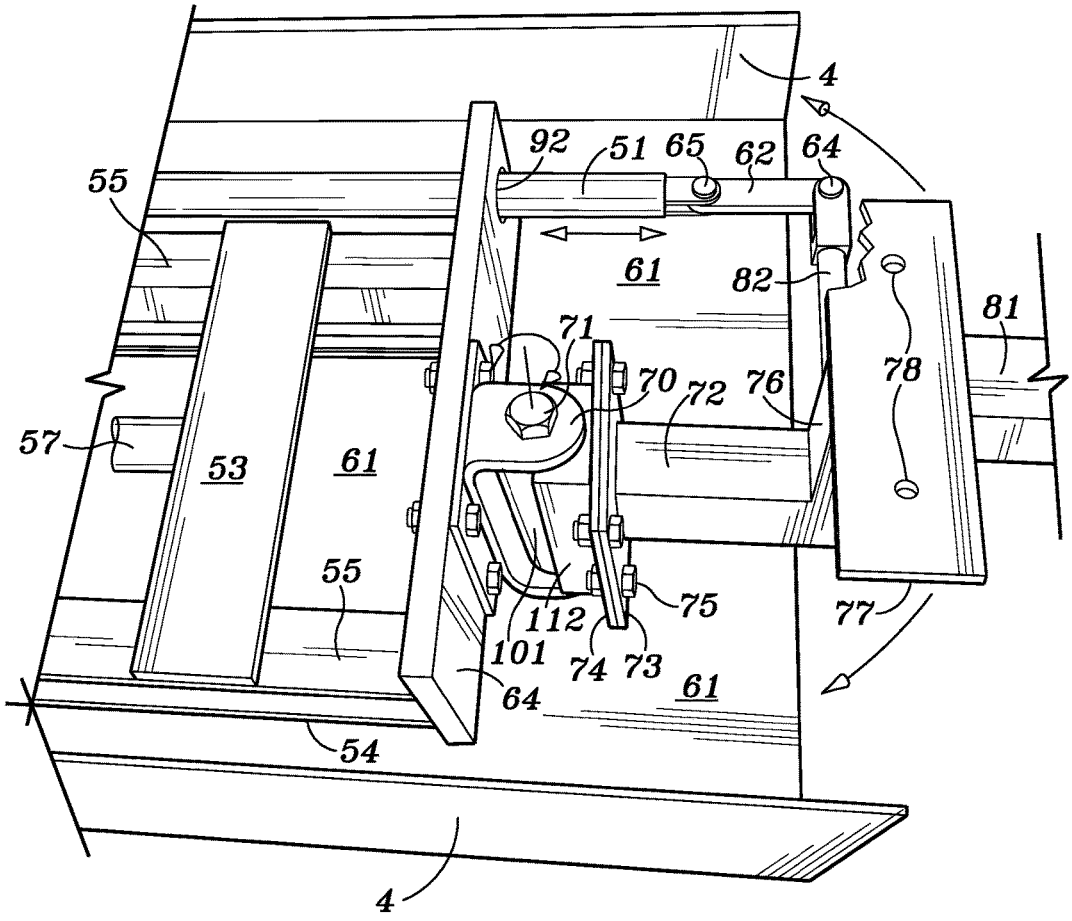
FIG. 4 is a detailed showing of an embodiment of the pivoting mechanism of the lower portion of the chair.

Referring now to FIGS. 3 and 4, a pivot support bracket 70 is rigidly attached to end plate 64 of carriage member 50. Pivot support bracket 70 includes a pivot pin 71. A flange plate 74 is rotatably secured within bracket 70 by pin 71. The lower body support 17 includes a first rectangular tube portion 72, a second rectangular tube portion 76 extending vertically above tube portion 72 and a third rectangular tube portion 81 extending generally parallel to tube portion 72. A flat mounting plate 77 rests atop the junction of tubes 76 and 81. Plate 77 includes a pair of apertures 78 for securing platform 27 thereto. A second flange plate 73 is secured to tube portion 72 and to flange plate 74 so that support assembly 72, 76, 81, and 77 pivots about pin 71. End plate 64 is provided with an aperture 92 through which linear actuator rod 51 extends. An electric linear actuator 48 and rod 51 is supported by and carried with carriage member 50, as seen in FIG. 3.

Figure 5:
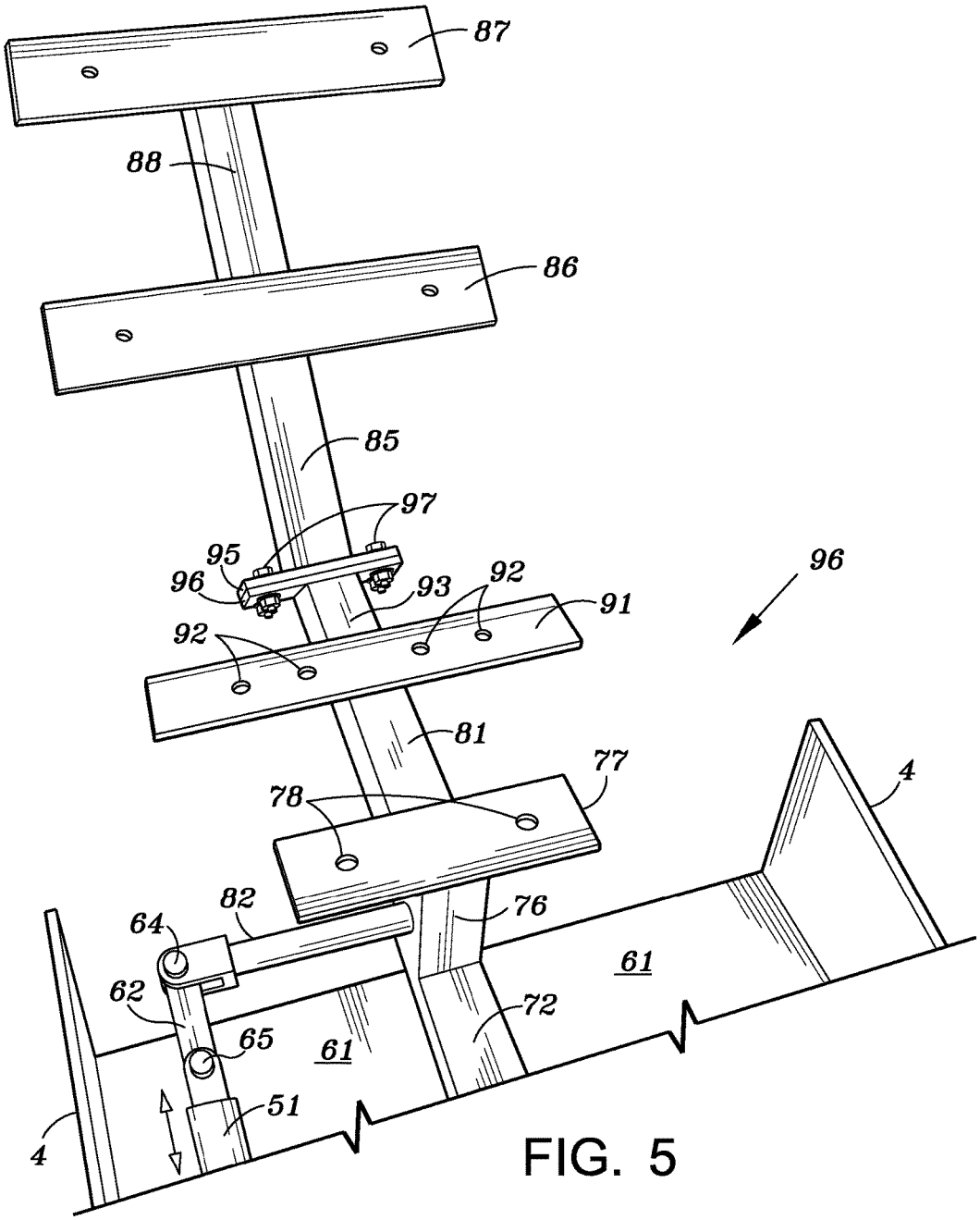
FIG. 5 is a perspective view of a portion of the support frame for an embodiment of the lower portion of the chair.

As shown in FIG. 5, frame member 81 supports a plate member 91 having apertures 92 for securing the lower portion of the chair to the frame. Member 81 has a flange 96 at its end for attachment to a further frame member 85 via a second flange 95. Bolts 97 may be used to secure the flanges together.

Frame member 85 extends upwardly at an angle from frame member 81. As shown in FIG. 5, a pair of support plates 86, 87 with suitable apertures are mounted on frame member 85 to support lower body member portion 19. Also a crank arm 82 is attached at one end to extension rod 51 and at its other end to support 76 in order to oscillate the lower support frame 96 about pivot pin 71.

The chair may be equipped with vibrators at various locations and also with heaters in any convenient location. Also a hand held wireless remote control or a wired controller may be used to control the various electronic elements of the chair including the vibrators, heaters, and electric linear actuators as known in the art. Electronic timers may also be included in the electronics to control the duration of the devices.

In use, a user may either lie horizontally on the chair in the position shown in FIG. 2 or begin by sitting in the chair in the position shown in FIG. 1.

In either instance, the upper back of the user would be positioned along support section 16 of the chair. The user's lower back would be supported by section 18 of the chair. The user's legs would be supported at the thighs by section 19 and the lower legs would be supported by section 20.

Lower body support member 17 including sections 18, 19, and 20 can be moved back and forth as shown at 96 in FIG. 2 relative to upper back support 16. This will gently massage and exercise the muscles as necessary. When support member 17 is moved to the left in FIG. 2, it may then be oscillated about pivot 71 to laterally move and exercise the lumbar and hip region of the back. While in the upright position shown in FIG. 1, supports 9 may be positioned under the user's arm pits to support the upper body while the lower support 17 is moved downwardly so as to enable the user's lower back muscles to be massaged and exercised. Lower support 17 may also be oscillated about pivot 71 in this position.

Although the present invention has been described with respect to specific details of an embodiment of the invention, it is not intended that such details should be regarded as limitations on the scope of the invention, except to the extent that they are included in the accompanying claims.

What is claimed is:

1. A reclinable therapeutic massage chair for use in exercising and strengthening the muscles in the back, redeveloping the muscles in the back, restoring motion to joints and alleviating soreness and stiffness in the joints and muscles of the back comprising:

a floor support assembly, a chair support frame pivotably attached to the floor support assembly, a linear actuator extending between the floor support assembly and the chair support frame for moving the chair support frame from an inclined position to a horizontal position, an upper back support mounted on the chair support frame and a lower body support member having a lower back support surface, a thigh support surface and a lower leg support surface, said lower body support member being mounted for both reciprocal and oscillating movement in a same plane on the chair support frame, the thigh support surface forming an obtuse angle with the lower back support surface and the lower leg surface is at an angle with respect to the thigh support surface, wherein the lower back support surface is located in the same plane as the upper back support, the thigh support surface and the lower leg support surface form an angle having an apex, with the apex adapted to be positioned behind a user's knee whereby when the chair is in the horizontal position, the user's thighs will be inclined upwardly toward the apex and the user's lower leg will extend downwardly from the apex.

2. The reclinable therapeutic massage chair of claim 1 wherein the floor support assembly includes a pair of horizontal frame members, a cross support member extending between the horizontal frame members and a pair of upright posts pivotably supporting the chair support frame.

3. The reclinable therapeutic massage chair according to claim 2 wherein the floor support assembly includes a second cross support member to which one end of the linear actuator is pivotably attached.

4. The reclinable therapeutic massage chair as claimed in claim 1 further including a pair of underarm supports mounted on the chair support frame.

5. The reclinable therapeutic massage chair as claimed in claim 1 further including a carriage member pivotably supporting the lower body support member, said carriage member being mounted on rails that are secured to a stationary frame on the chair support frame, and a second linear extendable actuator extending between the stationary frame and the carriage member.

6. The reclinable therapeutic massage chair according to claim 5 wherein the carriage member includes a second linear actuator secured thereto having an extension rod that is connected to a support frame for the lower body support member for oscillating the lower body support member about a pivot axis on the carriage member.

7. The reclinable therapeutic massage chair according to claim 1 wherein the same plane in which the lower body support member reciprocates and oscillates is horizontal plane.

* * * * *